US005377743A

United States Patent [19]

Schnakenburg et al.

[11] Patent Number: 5,377,743

[45] Date of Patent: Jan. 3, 1995

[54] MOLD FOR HORIZONTAL CONTINUOUS CASTING

[75] Inventors: Joachim v. Schnakenburg, Hillesheim; Dieter Perings, Büdesheim; Siegbert Wagner, Dahlem; Franz Keutgen, Lissendorf; Rüdiger Winterhager, Freudenberg; Peter Stadler, Siegen, all of Germany

[73] Assignee: Mannesmann Aktiengesellschaft, Dusseldorf, Germany

[21] Appl. No.: 92,552

[22] Filed: Jul. 16, 1993

[30] Foreign Application Priority Data

Jul. 22, 1992 [DE] Germany ..... 4224590

[51] Int. Cl.[6] ..... B22D 11/04; B22D 11/10

[52] U.S. Cl. ..... 164/440; 164/490

[58] Field of Search ..... 164/440, 490

[56] References Cited

U.S. PATENT DOCUMENTS

| | | | |
|---|---|---|---|
| 3,390,716 | 7/1968 | Rossing | 164/440 X |
| 3,506,063 | 4/1970 | Dain | 164/440 X |
| 3,593,778 | 7/1971 | Foye et al. . | |
| 3,730,251 | 5/1973 | Webbere et al. | 164/440 |
| 3,752,218 | 8/1973 | Gamble et al. | 164/440 |
| 4,340,110 | 7/1982 | Honda et al. | 164/440 X |
| 4,693,296 | 9/1987 | King | 164/440 |
| 4,774,996 | 10/1988 | Ahrens et al. | 164/440 X |
| 4,799,533 | 1/1989 | Ahrens et al. | 164/440 X |

FOREIGN PATENT DOCUMENTS

| | | | |
|---|---|---|---|
| 0187513 | 7/1986 | European Pat. Off. . | |
| 2520091 | 11/1976 | Germany . | |
| 61-144244 | 7/1986 | Japan | 164/440 |
| 62-151249 | 7/1987 | Japan | 164/440 |
| 62-224453 | 10/1987 | Japan | 164/440 |
| 267019 | 8/1986 | U.S.S.R. | 164/440 |
| WO90/07997 | 7/1990 | WIPO | 164/440 |

*Primary Examiner*—J. Reed Batten, Jr.

*Attorney, Agent, or Firm*—Cohen, Pontani, Lieberman, Pavane

[57] ABSTRACT

A mold for horizontal continuous casting of steel to form large-format slab cross sections, particularly flat products, includes a water-cooled metal casing forming the mold cavity for a slab and a brake ring for the melt feed which is supported at the mold on the pour-in side and connects the mold with a melt supply vessel (distributor) via a connecting casting tube. In order to provide an inexpensive and particularly stable mold, the mold is closed on the pour-in side by a metal plate along a part of the free cross-sectional area of the mold cavity. The plate has one or more openings for receiving a break ring. An end plate which overlaps the metal plate is arranged in front of the metal plate in surface contact with the metal plate. The end plate is provided with openings which coincide with the openings in the metal plate with respect to position and number. Ducts for guiding cooling water are incorporated in the end plate.

5 Claims, 4 Drawing Sheets

(A-B)

(C-D)

(G-H)

(I-K)

MOLD FOR HORIZONTAL CONTINUOUS CASTING

BACKGROUND OF THE INVENTION

1. Field of the Invention

The present invention relates to a mold for horizontal continuous casting of steel, in particular for producing flat products such as slabs. The mold includes a water-cooled metal casing forming a mold cavity for a slab and a breaking ring for the supply of melt. The breaking ring is supported at the mold on the pour-in side thereof and connects the mold with a melt supply vessel or distributor via a casting tube.

2. Description of the Related Art

In horizontal continuous casting plants, the molds are generally fastened to a side wall of a distributor. In many cases, the inlet cross section of a connecting part of first-class material between the distributor and mold is identical to the cross section of the mold (see DE-OS 25 20 091).

On the other hand, it is known from U.S. Pat. No. 3,593,778 to arrange a heat-conducting graphite plate having a plurality of through-flow openings between the distributor and a metal mold with a greater cross section than the feed channel of the distributor for the melt. In this way, heat is apparently conducted out of the melt in the transitional area between the distributor and mold to prevent cracks in the slab shell.

A more recent practice is to arrange a so-called break ring, preferably of boron nitride, between the feed nozzle and mold. The break ring is constructed in such a way that it forms the front boundary surface for the melt in the inlet region of the mold (see EP 0187 513 B1). The outer diameter of the breaking ring corresponds at least to the casting cross section of the mold and, as a result of its smaller inside diameter, forms a flange-like reduced diameter portion of the casting cross section of the mold. In contrast to the metal mold, this break ring is a part which is subject to wear and must be replaced frequently. However, break rings of boron nitride are expensive to produce and in large-site casting cross sections are costly and not very mechanically stable.

SUMMARY OF THE INVENTION

The invention seeks to avoid these disadvantages and to solve the problem with an inexpensive, mechanically more stable solution. In accordance with the present invention, a mold of the above-described type includes a metal plate for closing the mold on the pour-in side thereof along a portion of the free cross-sectional area of the mold cavity. The metal plate has one or more openings for receiving a break ring each. An end plate which overlaps the metal plate is arranged in front of the metal plate so as to be in surface contact therewith. The end plate is provided with openings which coincide with the openings in the metal plate. Ducts for conveying cooling water are incorporated in the end plate.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there is illustrated and described a preferred embodiment of the invention.

BRIEF DESCRIPTION OF THE DRAWINGS

FIGS. 4–7 show an end plate for the mold, wherein

FIG. 4 is a side view from the side of the mold;

FIG. 5 is a side view of the end plate according to FIG. 4 along sectional line E–F of FIG. 4;

FIG. 6 is a sectional view along line G–H according of FIG. 4; and

FIG. 7 is a sectional view along line I–K of FIG. 4.

DESCRIPTION OF THE PREFERRED EMBODIMENT

Figure 1:
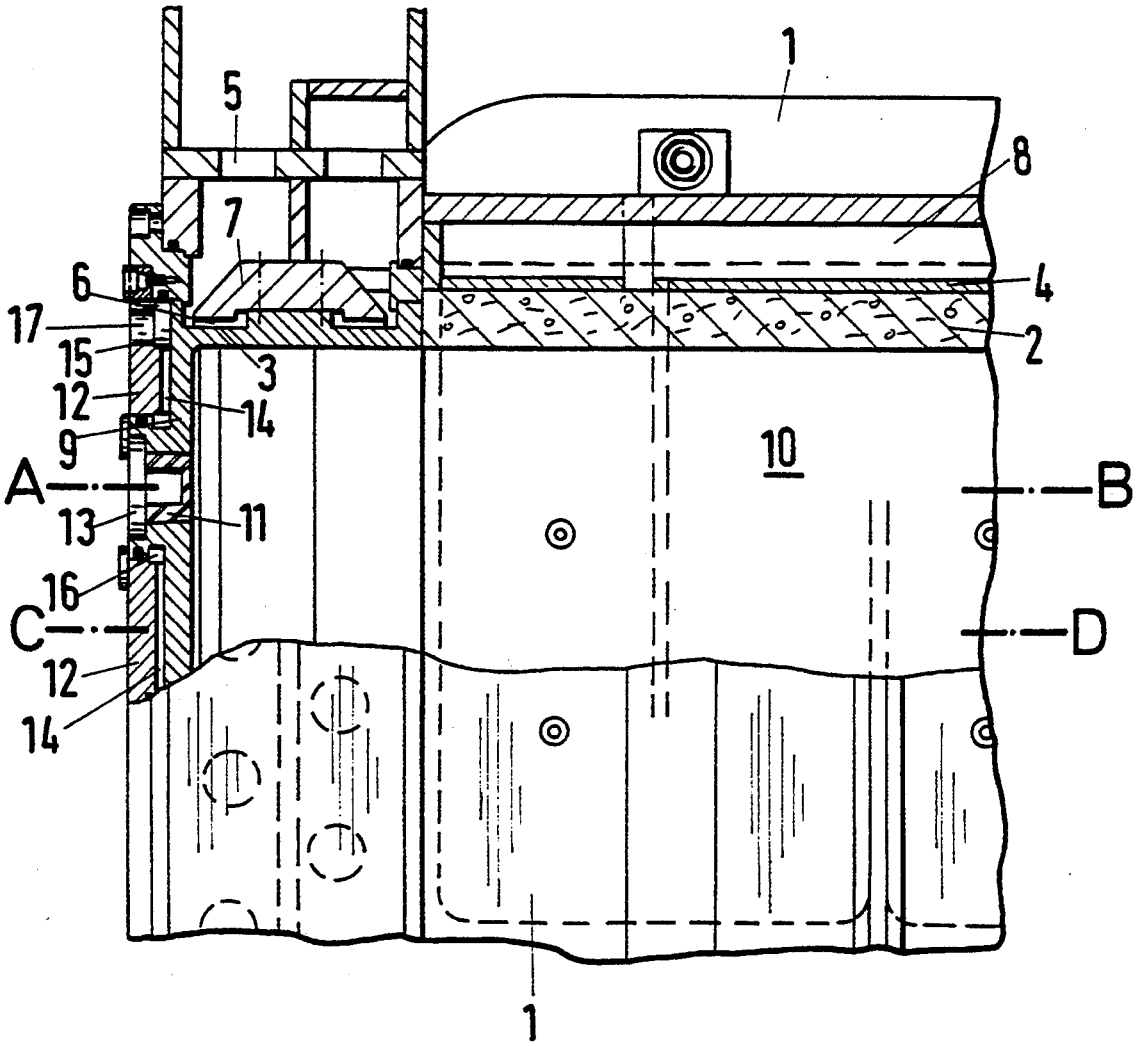
FIG. 1 is a top view of the mold according to the invention, partly in section.

Identical parts are designated by the same reference numbers in the drawing.

Figure 2:
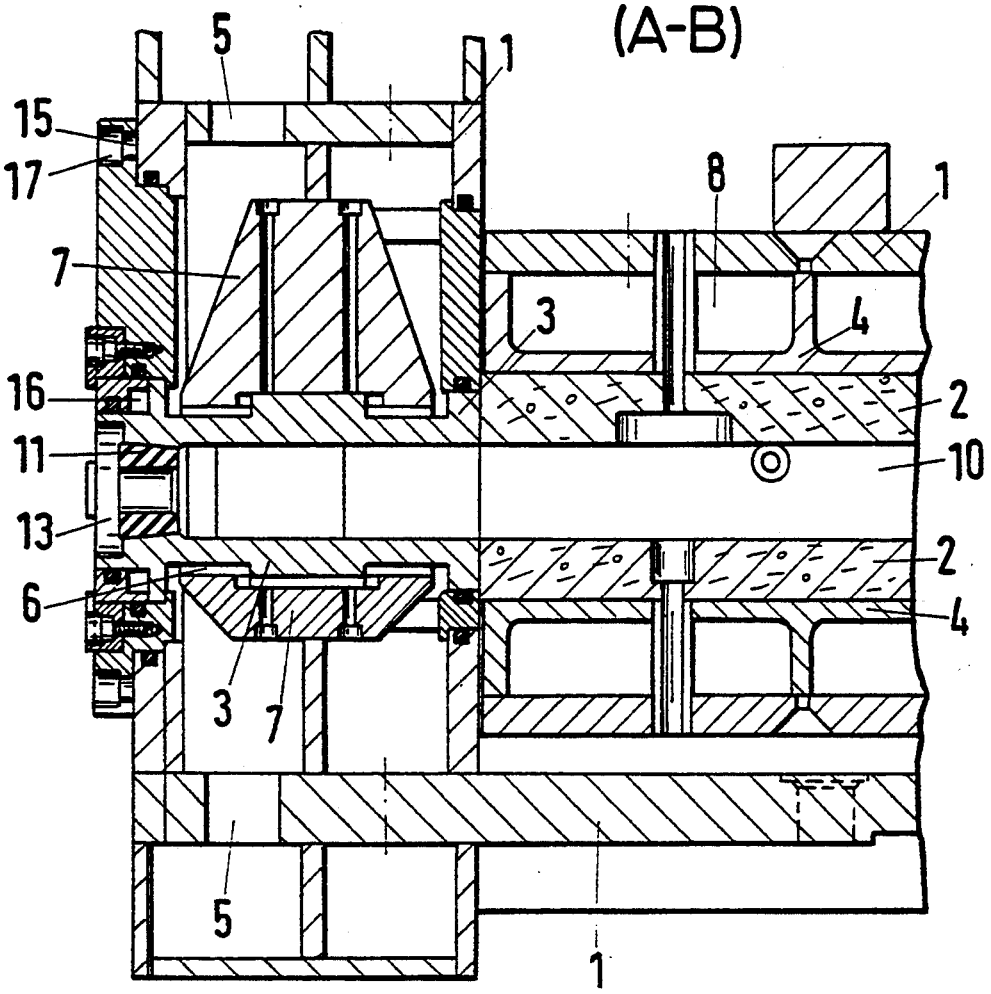
FIG. 2 is a side view along sectional line A–B of FIG. 1.
Figure 3:
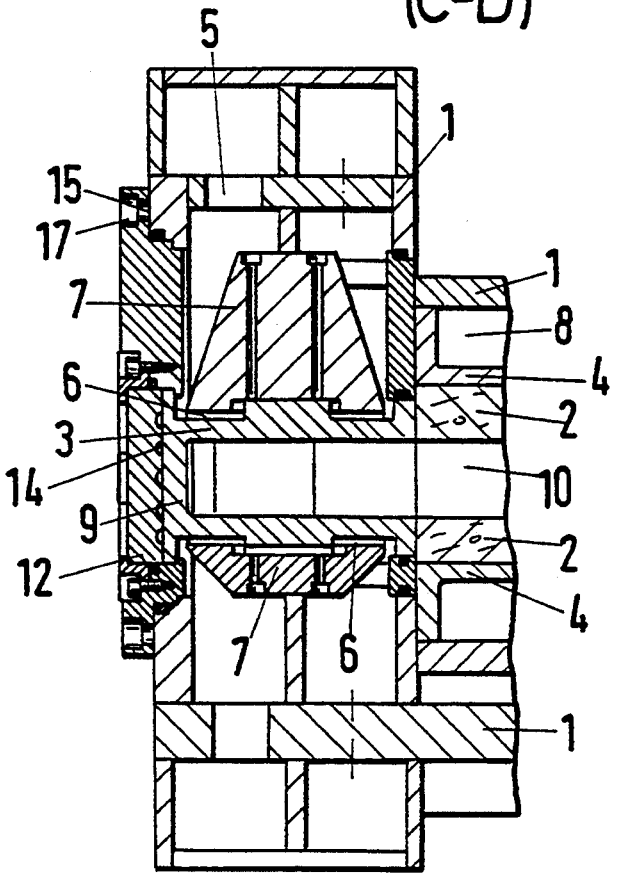
FIG. 3 is a sectional view on a larger scale, along sectional line C–D of FIG. 1.
Figure 4:
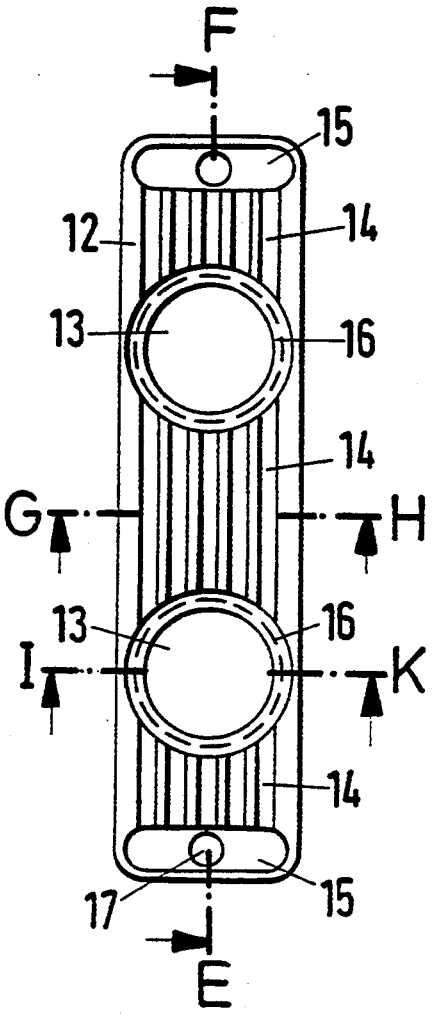
Figure 5:
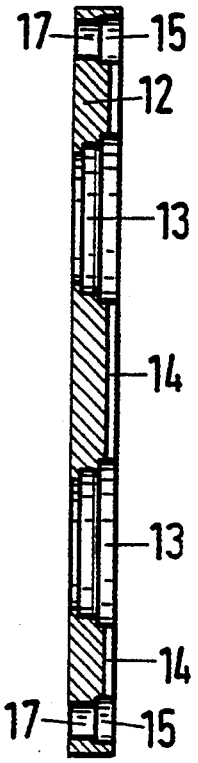
Figure 6:
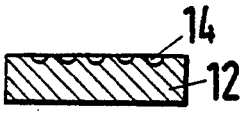
Figure 7:
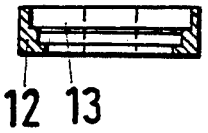

FIGS. 1, 2 and 3 show the pour-in side of a continuous casting mold for producing flat products such as slabs. The mold has a mold housing I with a crystallizer inserted therein. The crystallizer is formed by a graphite part 2 which forms the mold cavity 10 in combination with a copper module 3 arranged in front on the pour-in side. The graphite part 2 is supported by metal plates 4.

The mold is water-cooled. The cooling water is supplied to the copper module 3 via connections 5 and the heat is carried off via gaps 6 formed by the rear wall of the copper module 3 and a displacement body 7 arranged behind the latter. Similarly, the graphite part 2 is cooled via the coolant space 8 between the metal plates 4 and the mold housing 1.

According to the invention, the copper module 3 is closed on the pour-in side by a plate 9 along a part of the free cross-sectional area of the mold cavity 10. The plate 9 can be fastened to the copper module 3 at the front, but is preferably a component part of the copper module 3 itself. A circular transition exists between the inner wall surface of the copper module 3 and the plate 9. Depending on the dimensions of the cross-sectional area of the mold cavity 10, one or more circular openings are provided in the plate 9. The openings narrow in diameter in a slightly conical manner toward the mold cavity 10 and each opening serves to receive a break ring 11, preferably of boron nitride.

An end plate 12 is arranged in front of the copper module 3 and the plate 9 of the copper module 3. The end plate 12 is shown in FIGS. 4 to 7. The dimensions of this end plate 12 are such that the cross-sectional area of the copper module 3 is exceeded. Further, the end plate 12 has openings 13 which coincide with the openings for receiving the break rings 11 in the plate 9 depending on position and number. Ducts 14 are incorporated on the side of the end plate 12 associated with the plate 9. Coolant flows through these ducts 14 which are open toward the plate 9 and extend from one end of the plate 12 to the other. On one side, the ducts 14 open out at the ends of the plate 12 into transversely arranged distributor ducts 15 which are connected with connection pieces 17. On the other side, the ducts 14 open into annular ducts 16 which surround the recesses 13.

The invention can be applied in all conventional dimensions and formats, e.g. rectangular formats in slabs, square and circular cross sections.

It is viewed as particularly advantageous that the break rings be dimensioned in such a way that the ratio between the free through-flow cross section of the break ring to the clear cross-sectional area of the mold is 1:2.5 to 1:50.

Various advantages are achieved by the invention. For example, three small break rings are less expensive to produce than a correspondingly large break ring. Further, small break rings are more mechanically stable, which also leads to increased operating reliability. Stocking is also simplified since standard rings can be used which can also be employed for different casting cross sections. The standard rings offer the further advantage that the annular seat in the copper module need not be reworked.

The invention is not limited by the embodiment described above which is presented as an example only but can be modified in various ways within the scope of protection defined by the appended patent claims.

We claim:

1. A mold for horizontal continuous casting of steel for producing large-size slab cross sections, the mold comprising a water-cooled metal casing forming a mold cavity for a slab, the mold cavity having a pour-in side and defining a free cross-sectional area, and a metal plate for closing the mold cavity on the pour-in side thereof along a portion of the free cross-sectional area of the mold cavity, the metal plate having at least one opening for receiving a break ring, each break ring being connected to a distributor through a casting tube for supplying melt, an end plate which overlaps the metal plate being arranged in front of the metal plate in surface contact therewith, the end plate being provided with at least one opening which coincides with the at least one opening of the metal plate, the end plate defining ducts for conveying cooling water therethrough.

2. The mold according to claim 1, wherein the end plate has a contact surface in contact with the metal plate, the ducts being formed in the contact surface of the end plate, the end plate having end portions, the ducts having first and second sides, the first sides of the ducts being in communication with distributor ducts arranged in the end portions of the end plate and extending transversely of the ducts, the distributor ducts being in communication with connection pieces, and the second sides of the ducts being in communication with annular ducts, wherein the annular ducts surround the openings of the end plate.

3. The mold according to claim 1, comprising a copper module forming a pour-in region of the modular cavity, the metal plate being a component part of the copper mold.

4. The mold according to claim 3, comprising a radially extending transition from the metal plate to the copper module in a cross-sectional plane.

5. The mold according to claim 1, wherein each break ring has a free cross-sectional area, and wherein the ratio of the free cross-sectional area of the break ring to the free cross-sectional area of the mold cavity is 1:2.5 to 1:50.

* * * * *